US012696988B2

(12) United States Patent
Barlatt

(10) Patent No.: US 12,696,988 B2
(45) Date of Patent: Aug. 4, 2026

(54) HAIRPIECE STAND

(71) Applicant: Sabine Barlatt, Acworth, GA (US)

(72) Inventor: Sabine Barlatt, Acworth, GA (US)

( * ) Notice: Subject to any disclaimer, the term of this patent is extended or adjusted under 35 U.S.C. 154(b) by 21 days.

(21) Appl. No.: 18/946,025

(22) Filed: Nov. 13, 2024

(65) Prior Publication Data

US 2025/0160543 A1 May 22, 2025

Related U.S. Application Data

(60) Provisional application No. 63/602,062, filed on Nov. 22, 2023.

(51) Int. Cl.
*A47F 7/06* (2006.01)
*A45C 11/00* (2006.01)

(52) U.S. Cl.
CPC ..... *A47F 7/065* (2013.01); *A45C 11/00* (2013.01)

(58) Field of Classification Search
CPC ..... A47F 7/065; A45C 11/00; A45D 44/00; A45D 44/005; A41G 3/0041
See application file for complete search history.

(56) References Cited

U.S. PATENT DOCUMENTS 1,782,414 A * 11/1930 Duer ..... A45C 11/02 206/8
2,094,810 A * 10/1937 Oppenheimer ..... A47F 7/06 33/8
3,312,439 A * 4/1967 Swee ..... A47F 7/065 248/176.1
3,465,926 A * 9/1969 Schwartz ..... A45D 44/14 248/176.1
3,515,318 A * 6/1970 Preble ..... A45D 44/14 223/66
3,603,322 A * 9/1971 Wilson ..... A45C 11/00 206/8
3,621,988 A * 11/1971 Songer ..... A45C 11/00 206/757
3,770,114 A * 11/1973 Jackson ..... A45C 11/00 220/4.27
3,779,433 A * 12/1973 Imai ..... A45D 44/14 223/66
3,885,718 A 5/1975 Clemence
4,616,747 A * 10/1986 Zimmerman ..... A45D 4/02 248/176.1

(Continued)

FOREIGN PATENT DOCUMENTS

CN 110381773 A * 10/2019 ..... A45D 19/06
KR 2014001709 U * 3/2014

(Continued)

*Primary Examiner* — Eret C Mcnichols
(74) *Attorney, Agent, or Firm* — The Law Firm of Andrea Hence Evans, LLC

(57) ABSTRACT

Disclosed herein is a vessel configured to hold one or more objects. The vessel serves as a base and is configured to have an anchoring structure that supports a rod in an upright position. The rod may have a hairpiece connected to an end of the rod. The rod may be adjustable so as to lengthen or shorten the height of the support structure to a desirable height and based on the length of hair of the wig mounted on the support structure. A support structure may be removably connected to the rod. The support structure may expand and/or retract to accommodate a plurality of differing sized wigs.

16 Claims, 12 Drawing Sheets

(56) References Cited

U.S. PATENT DOCUMENTS 4,688,685 A * 8/1987 Brace ..... A47F 5/04 211/70.5
5,188,244 A * 2/1993 Hollstegge ..... D06F 59/00 211/85.15
D351,745 S * 10/1994 Seifert ..... D6/682.6
5,772,050 A * 6/1998 Shih ..... B41K 1/58 211/205
5,894,944 A * 4/1999 Swift ..... A47G 23/08 211/133.4
6,367,494 B1 * 4/2002 Tung ..... E01F 9/662 135/48
6,578,716 B1 * 6/2003 Wei ..... A47F 7/06 223/12
6,889,953 B2 * 5/2005 Harbaugh ..... E04H 12/2246 248/539
7,028,853 B1 * 4/2006 Simms ..... A45D 8/002 D3/901
7,168,577 B1 * 1/2007 Moseley ..... A47F 7/06 211/32
D604,109 S * 11/2009 Madagan ..... A21B 3/132 D7/610
7,614,600 B1 * 11/2009 Smith ..... E04H 12/2246 248/910
8,051,994 B2 * 11/2011 Jin ..... A01N 1/142 211/144
8,186,524 B2 * 5/2012 Siahpush ..... A47F 7/283 211/133.4
D677,833 S * 3/2013 Key ..... D3/279
8,500,074 B1 * 8/2013 Cochran ..... B62H 3/12 248/129
8,833,709 B2 * 9/2014 Weng ..... A45B 23/00 248/129
8,950,591 B1 * 2/2015 McDowell ..... A45D 44/14 211/13.1
9,204,761 B2 * 12/2015 Volk ..... F16M 11/04
9,226,606 B1 * 1/2016 Nesladek ..... A47G 25/10
9,427,066 B2 8/2016 Davidson
9,538,831 B1 * 1/2017 Tracy ..... D06F 57/04
9,540,840 B2 * 1/2017 Ma ..... F16M 13/00
9,609,931 B2 * 4/2017 Rosenblatt ..... A45C 11/00
10,006,707 B1 * 6/2018 Wiley ..... A45D 20/14
10,117,486 B2 * 11/2018 Cook ..... B65D 43/02
10,231,557 B2 * 3/2019 Wilke ..... A47F 5/112
10,905,261 B2 2/2021 Simmons
11,259,655 B1 * 3/2022 Humphries ..... A45D 44/14
11,707,145 B2 * 7/2023 Johnson ..... A47K 3/281 211/30
D1,017,909 S * 3/2024 Xie ..... D28/93
11,946,271 B2 * 4/2024 Shaffer ..... A45B 11/00
12,007,065 B2 * 6/2024 Ma ..... E04H 12/2238
12,115,646 B1 * 10/2024 Chuang ..... B62H 3/12
12,256,819 B2 * 3/2025 Foster ..... A45C 11/24
12,279,682 B1 * 4/2025 Li ..... A45C 5/08
12,329,255 B1 * 6/2025 Williams ..... A45C 11/008
2004/0069922 A1 * 4/2004 Wu ..... E04H 12/2246 248/519
2009/0218376 A1 * 9/2009 King ..... A45D 44/14 206/8
2011/0232704 A1 * 9/2011 Li ..... A45B 25/14 248/522
2015/0129455 A1 * 5/2015 Williams ..... A45D 44/00 206/526
2020/0015606 A1 * 1/2020 Ji ..... A45D 44/14
2021/0112948 A1 4/2021 Wachtfogel et al.
2022/0167761 A1 * 6/2022 Lipsey ..... A41G 3/0041
2024/0335936 A1 * 10/2024 Chuang ..... B25H 1/0014

FOREIGN PATENT DOCUMENTS

KR 101764243 B1 * 8/2017 ..... A47F 7/08
WO 2004071232 A2 8/2004

* cited by examiner

HAIRPIECE STAND

RELATED APPLICATIONS

This application claims the benefit of U.S. Provisional Patent Application No. 63/602,062, filed Nov. 22, 2023, entitled "HAIRPIECE STAND", the entire contents of which are hereby incorporated by reference herein.

FIELD OF INVENTION

Embodiments disclosed herein relate to a portable hairpiece stand, more particularly to a vessel configured to retain an adjustable rod and a hairpiece support structure during storage and configured to support the adjustable rod and a hairpiece support structure during use.

BACKGROUND OF THE INVENTION

Portable hairpiece containers and stands have a relatively modern history, with their development closely tied to the evolving needs and preferences of hairpiece wearers. In the early to mid-20th century, hairpieces were commonly used, particularly in the entertainment industry and by those experiencing hair loss due to medical reasons. However, there was a lack of specialized storage solutions for hairpieces. Some individuals resorted to makeshift methods of storing hairpieces, using hatboxes or other containers not specifically designed for hairpieces. Traditional hairpiece storage methods, such as using hatboxes or makeshift stands, may not provide an optimal solution for protecting and maintaining the shape of hairpieces, especially during travel. The emergence of specialty containers is seen as hairpieces gained popularity in various segments of society and the demand for dedicated storage solutions increased. Many specialty hairpiece containers are designed to support the hairpiece while it was not in use, maintaining its shape and preventing tangling.

For example, in response to the diverse preferences and needs of hairpiece wearers, some modern hairpiece containers may incorporate additional features such as LED lighting, built-in mirrors, and digital humidity control to enhance the overall hairpiece care experience. However, the long-felt, yet unfulfilled need for an improved portable hairpiece stand may be attributed to several factors such as a lack of convenient storage solutions in today's market. With an increasing number of people using hairpieces for various reasons (cosmetic, medical, theatrical, etc.), there has been a corresponding rise in the demand for accessories and tools that facilitate hairpiece care and maintenance. Further, modern lifestyles often involve frequent travel, whether for work, leisure, or other commitments. This necessitates a need for portable solutions that may easily accompany individuals on their journeys. In another example, some hairpiece wearers have specific needs, such as those related to medical hair loss, theatrical performances, or fashion choices. These individuals may require a more tailored solution for storing and transporting their hairpieces. As hairpieces have evolved to incorporate different materials and construction techniques, there is a corresponding need for storage solutions that accommodate these features.

Many hairpiece wearers often have different styles and sizes of hairpieces in their collection. A portable hairpiece stand that adjusts to accommodate various hairpiece types fulfills a versatile storage need. In an example of professional use in the entertainment industry, actors, performers, and stylists in the entertainment may have a need for portable hairpiece stands to ensure that hairpieces remain in top condition during rehearsals, performances, and travels. Despite the need, the development of a suitable, functional, and easily transportable hairpiece stand that incorporates many desired features may have faced technological and design challenges. Thus, there is a need for a portable hairpiece stand with adjustable features and the ability to securely hold hairpieces of various sizes and directly addresses these concerns. As a result, it would provide a convenient and practical solution for hairpiece wearers, professionals, and enthusiasts alike, helping to bridge the gap in the market for a versatile and portable hairpiece stand.

Accordingly, there remains a need for improved portable hairpiece stand. This need and other needs are satisfied by the various aspects of the present disclosure.

SUMMARY OF THE INVENTION

In accordance with the principles of the present invention, a portable hairpiece stand has an adjustable rod that may increase and/or decrease the height of the rod, and the inclusion of a support structure such as a helmet and/or a headpiece that may adapt to different hairpiece and/or wig sizes that connects to an end of the rod, represents a notable advancement in the field of portable hairpiece containers and stands. This portable hairpiece stand addresses the practical concerns of transportation and storage while ensuring a secure and adjustable fit for various hairpiece styles and sizes. In response to the diverse preferences and needs of hairpiece wearers, some features of the portable hairpiece stand include a customizable and personalized hairpiece container and stands having interchangeable shelving and dividers, and which also includes improvements that overcome the limitations of prior portable hairpiece stands is now met by a new, useful, and non-obvious invention.

A vessel may comprise four sidewalls and a base. The base may have an outer perimeter edge connected to the four sidewalls to form a chamber. The chamber may have an inner wall. The base may have an opening bordering a compartment. The compartment may have an anchoring structure. A first rod may be removably connected to the anchoring structure. A support structure may be connected to the first rod. The support structure may be configured to receive at least a portion of a hairpiece. A cover may be removably connected to the four sidewalls.

The base may have a radiused wall. The cover may be hingedly pivotable. The cover may be substantially planar. The chamber may have multiple compartments divided by one or more dividers. One or more shelving units may be connected to the inner wall of the chamber. A handle may be connected to one side wall of the four side walls and may be configured to be grasped by a user.

The anchoring structure may be a protrusion extending from the floor of the compartment. The first rod may be configured to telescope from a retracted position to an extended position. The first rod may have a first end opposite a second end, with the first end removably connected to the anchoring structure and the second end connected to a first end of a second rod. The first rod may have a substantially central bore, with at least a portion configured to be received by the anchoring structure during installation.

The support structure may have one or more tracks configured to expand and retract a first portion and a second portion of the support structure. The one or more tracks may have openings configured to receive a fastener. The support structure may have a lock and key mechanism comprising a convex structure on the first portion and a recess on the second portion, with the convex structure configured to be received by the recess when retracted. The support structure may have a receiving structure to retain at least a portion of the first rod. The support structure may have slits radiating from the convex structure and recess.

Additional aspects of the invention will be set forth in part in the description which follows, and in part will be obvious from the description, or can be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several aspects of the invention and together with the description, serve to explain the principles of the invention.

Figure 1A:
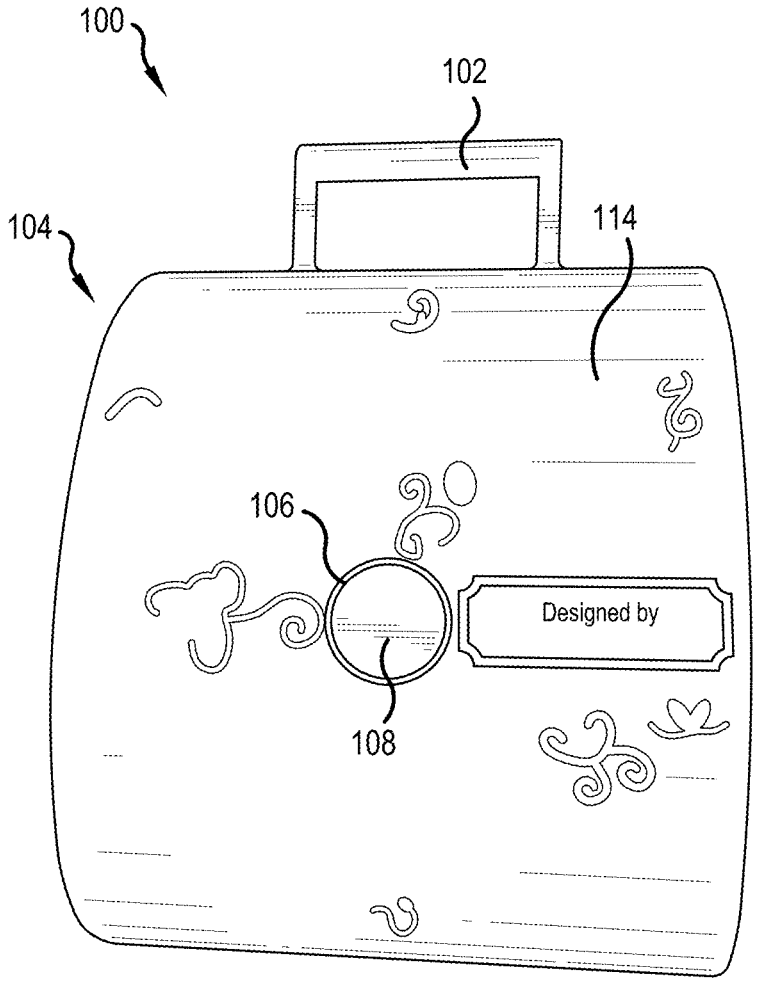
FIGS. 1A, and 1B shows a top perspective view of the vessel in a closed orientation, in accordance with an exemplary embodiment of the present invention.

Reference is made in the following detailed description to accompanying drawings, which form a part hereof, wherein like numerals may designate like parts throughout that are corresponding and/or analogous. It will be appreciated that the figures have not necessarily been drawn to scale, such as for simplicity and/or clarity of illustration. For example, dimensions of some aspects may be exaggerated relative to others. Further, it is to be understood that other embodiments may be utilized. Furthermore, structural and/or other changes may be made without departing from claimed subject matter. References throughout this specification to "claimed subject matter" refer to subject matter intended to be covered by one or more claims, or any portion thereof, and are not necessarily intended to refer to a complete claim set, to a particular combination of claim sets (e.g., method claims, apparatus claims, etc.), or to a particular claim. It should also be noted that directions and/or references, for example, such as up, down, top, bottom, and so on, may be used to facilitate discussion of drawings and are not intended to restrict application of claimed subject matter. Therefore, the following detailed description is not to be taken to limit claimed subject matter and/or equivalents.

DETAILED DESCRIPTION OF THE INVENTION

The present invention can be understood more readily by reference to the following detailed description of the invention and the Examples included therein.

Before the present articles, systems, devices, and/or methods are disclosed and described, it is to be understood that they are not limited to specific manufacturing methods unless otherwise specified, or to particular materials unless otherwise specified, as such can, of course, vary. It is also to be understood that the terminology used herein is for the purpose of describing particular aspects only and is not intended to be limiting. Although any methods and materials similar or equivalent to those described herein can be used in the practice or testing of the present invention, example methods and materials are now described.

All publications mentioned herein are incorporated herein by reference to disclose and describe the methods and/or materials in connection with which the publications are cited.

A. Definitions

It is also to be understood that the terminology used herein is for the purpose of describing particular aspects only and is not intended to be limiting. As used in the specification and in the claims, the term "comprising" can include the aspects "consisting of" and "consisting essentially of." Unless defined otherwise, all technical and scientific terms used herein have the same meaning as commonly understood by one of ordinary skill in the art to which this invention belongs. In this specification and in the claims which follow, reference will be made to a number of terms which shall be defined herein.

As used in the specification and the appended claims, the singular forms "a," "an" and "the" include plural referents unless the context clearly dictates otherwise. Thus, for example, reference to "an opening" can include two or more openings.

Ranges can be expressed herein as from one particular value, and/or to another particular value. When such a range is expressed, another aspect includes from the one particular value and/or to the other particular value. Similarly, when values are expressed as approximations, by use of the antecedent 'about,' it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein, the terms "about" and "at or about" mean that the amount or value in question can be the value designated by some other value approximately or about the same. It is generally understood, as used herein, that it is the nominal value indicated ±10% variation unless otherwise indicated or inferred. The term is intended to convey that similar values promote equivalent results or effects recited in the claims. That is, it is understood that amounts, sizes, formulations, parameters, and other quantities and characteristics are not and need not be exact, but can be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such. It is understood that where "about" is used before a quantitative value, the parameter also includes the specific quantitative value itself, unless specifically stated otherwise.

The terms "first," "second," "first part," "second part," and the like, where used herein, do not denote any order, quantity, or importance, and are used to distinguish one element from another, unless specifically stated otherwise.

As used herein, the terms "optional" or "optionally" means that the subsequently described event or circumstance can or cannot occur, and that the description includes instances where said event or circumstance occurs and instances where it does not. For example, the phrase "optionally affixed to the surface" means that it can or cannot be fixed to a surface.

Moreover, it is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

Disclosed are the components to be used to manufacture the disclosed devices, systems, and articles of the invention as well as the devices themselves to be used within the methods disclosed herein. These and other materials are disclosed herein, and it is understood that when combinations, subsets, interactions, groups, etc. of these materials are disclosed that while specific reference of each various individual and collective combinations and permutation of these materials cannot be explicitly disclosed, each is specifically contemplated and described herein. For example, if a particular material is disclosed and discussed and a number of modifications that can be made to the materials are discussed, specifically contemplated is each and every combination and permutation of the material and the modifications that are possible unless specifically indicated to the contrary. Thus, if a class of materials A, B, and C are disclosed as well as a class of materials D, E, and F and an example of a combination material, A-D is disclosed, then even if each is not individually recited each is individually and collectively contemplated meaning combinations, A-E, A-F, B-D, B-E, B-F, C-D, C-E, and C-F are considered disclosed. Likewise, any subset or combination of these is also disclosed. Thus, for example, the sub-group of A-E, B-F, and C-E would be considered disclosed. This concept applies to all aspects of this application including, but not limited to, steps in methods of making and using the articles and devices of the invention. Thus, if there are a variety of additional steps that can be performed it is understood that each of these additional steps can be performed with any specific aspect or combination of aspects of the methods of the invention.

It is understood that the devices and systems disclosed herein have certain functions. Disclosed herein are certain structural requirements for performing the disclosed functions, and it is understood that there are a variety of structures that can perform the same function that are related to the disclosed structures, and that these structures will typically achieve the same result.

While aspects of the present invention can be described and claimed in a particular statutory class, such as the system statutory class, this is for convenience only and one of skill in the art will understand that each aspect of the present invention can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way appreciably intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

FIGS. 1A-9B illustrate vessel 100. Vessel 100 may include, but not be limited to a container, a receptable, a carrier, a holder, and/or a case configured to hold one or more objects. The vessel 100 is hollow and may retain one or more rods, a hairpiece, and/or a support structure. The vessel 100 serves as a base and is configured to have an anchoring structure that supports a rod in an upright position. The rod may have a hairpiece connected to an end of the rod. The rod may be adjustable so as to lengthen and/or shorten the height of the support structure to a desirable height and based on the length of hair of the wig mounted on the support structure. A support structure may be removably connected to the rod. The support structure may be substantially spherical in shape so as to mimic the shape of a human head so that the shape of a hairpiece such as a wig may maintain a proper shape when the wig is mounted on the support structure. The support structure may expand and/or retract to accommodate a plurality of differing sized wigs.

Figure 1B:
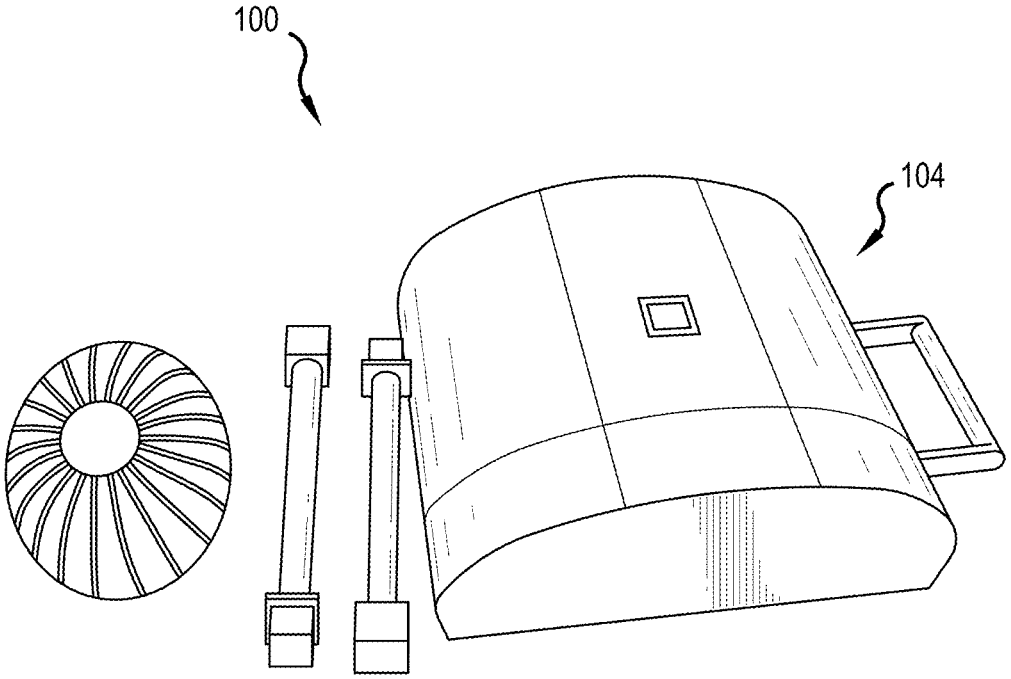

FIGS. 1A and 1B illustrates vessel 100 having a base 114. The base 114 may have a radiused wall with a curvature. Ornamental designs can be on the surface of the base, as desired by the manufacturer. The vessel 100 has a closed orientation 104. The base 114 has an opening 106. A lid 108 is removably connected to the base 114 and is configured to cover the opening 106. A handle 102 may extend from the vessel 100.

Figure 2:
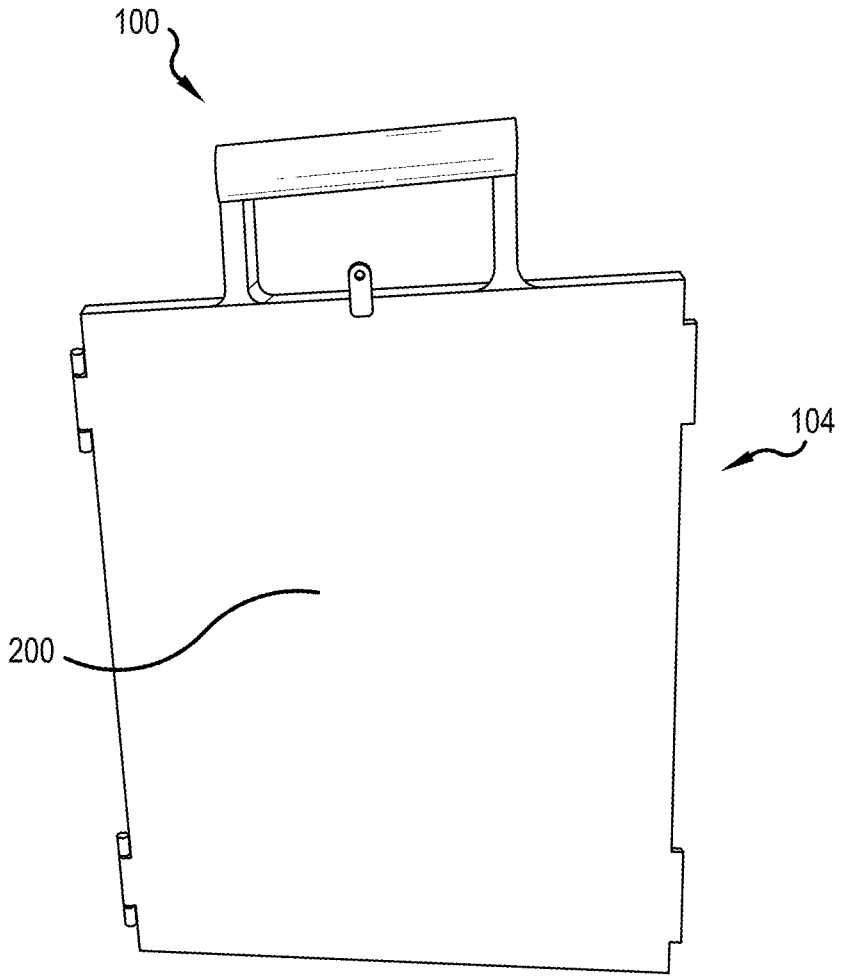
FIG. 2 shows a rear perspective view of the vessel in a closed orientation, in accordance with an exemplary embodiment of the present invention.

FIG. 2 illustrates vessel 100 having cover 200 being substantially planar and located opposite the base. The cover 200 may be opened and/or closed. The cover 200 is configured to be disposed on a flat surface during use. The vessel 100 has a closed orientation 104.

Figure 3:
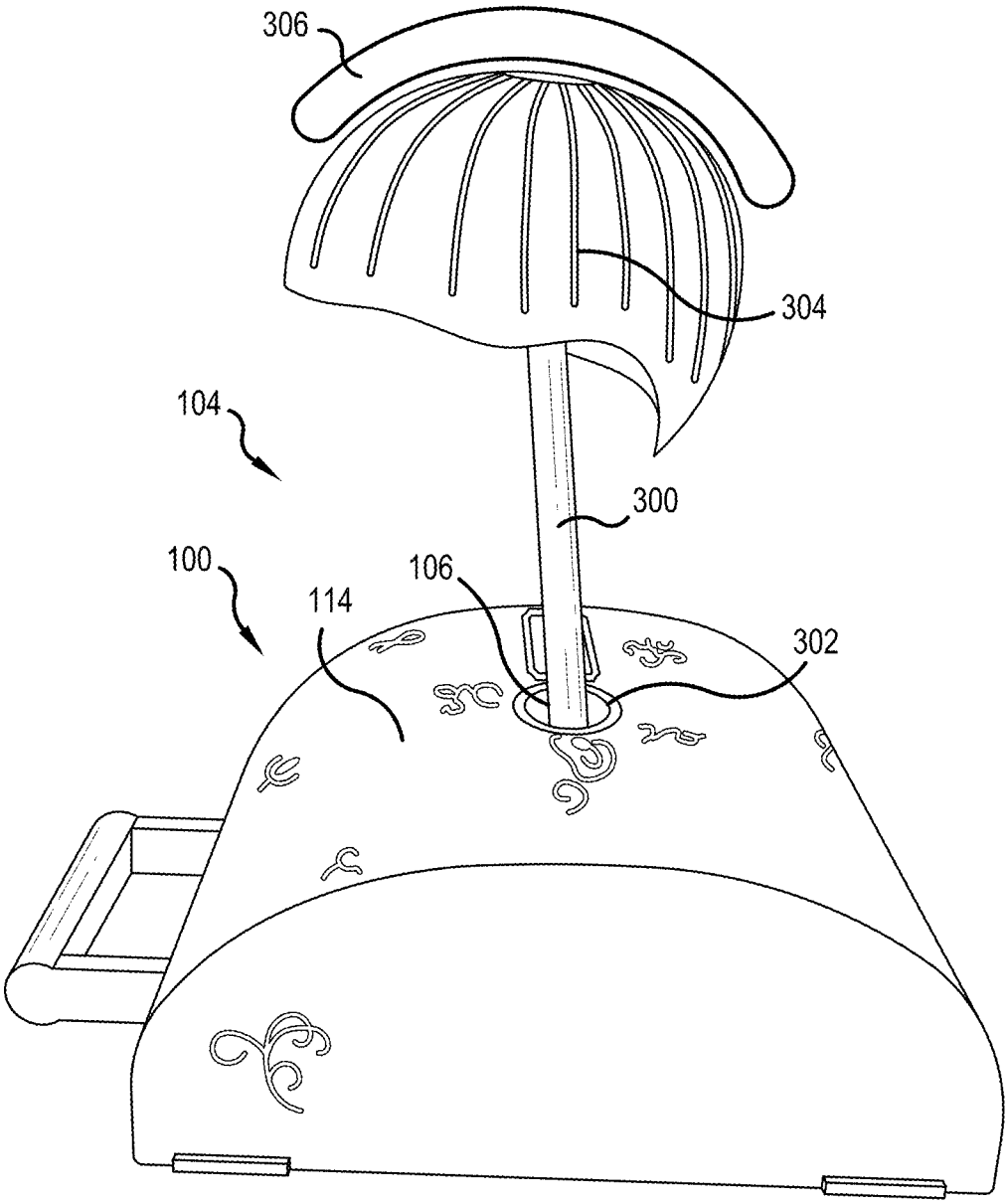
FIG. 3 shows a left side perspective view of the adjustable rod, in a lower orientation, having an end connected to an anchoring structure within a compartment of an opening of the radiused wall of the vessel and another end of the rod connected to a hairpiece support structure, in accordance with an exemplary embodiment of the present invention.
Figure 4:
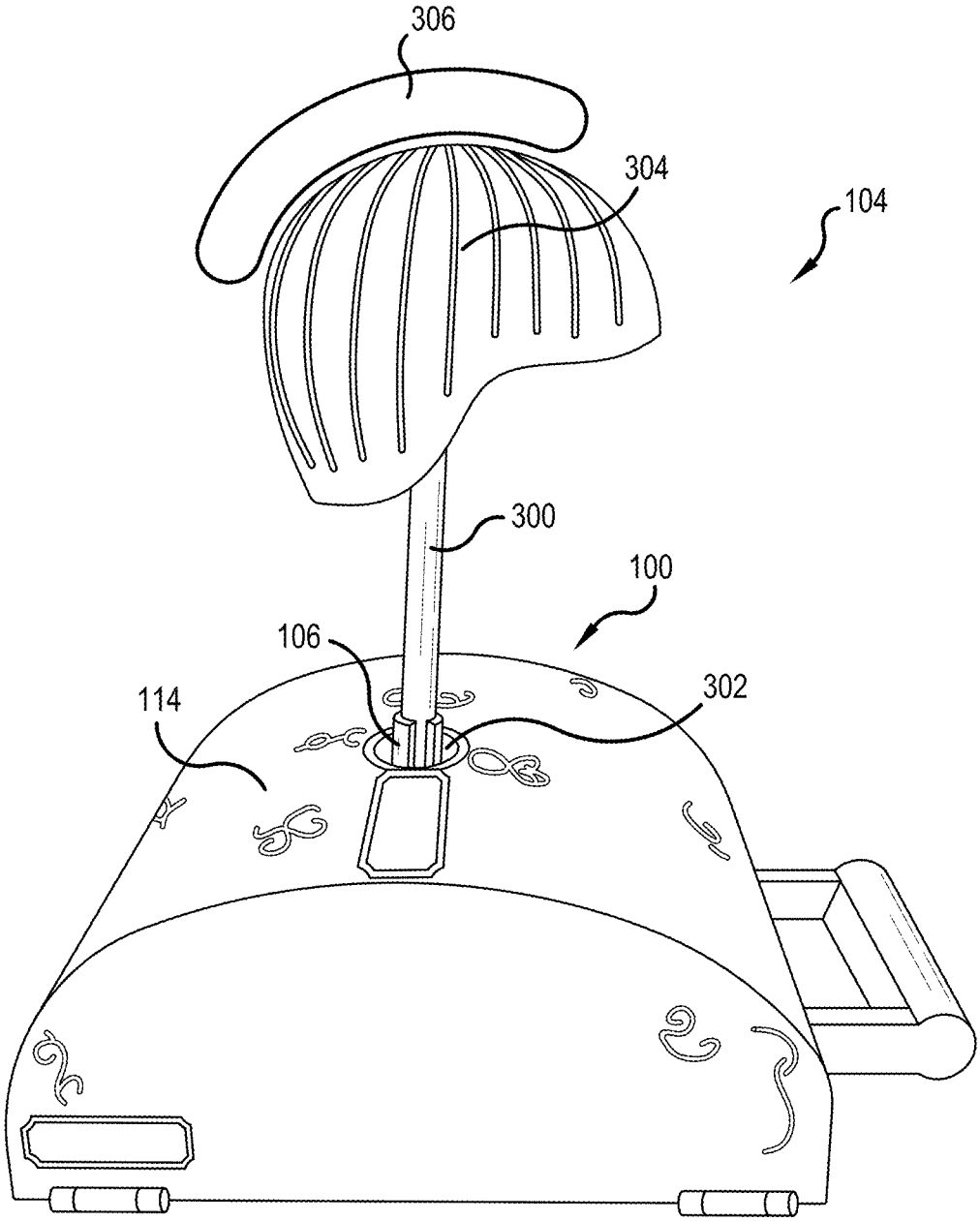
FIG. 4 shows a right side perspective view of the adjustable rod, in a lower orientation, having an end connected to an anchoring structure within a compartment of an opening of the radiused wall of the vessel and another end of the rod connected to a hairpiece support structure, in accordance with an exemplary embodiment of the present invention.
Figure 5:
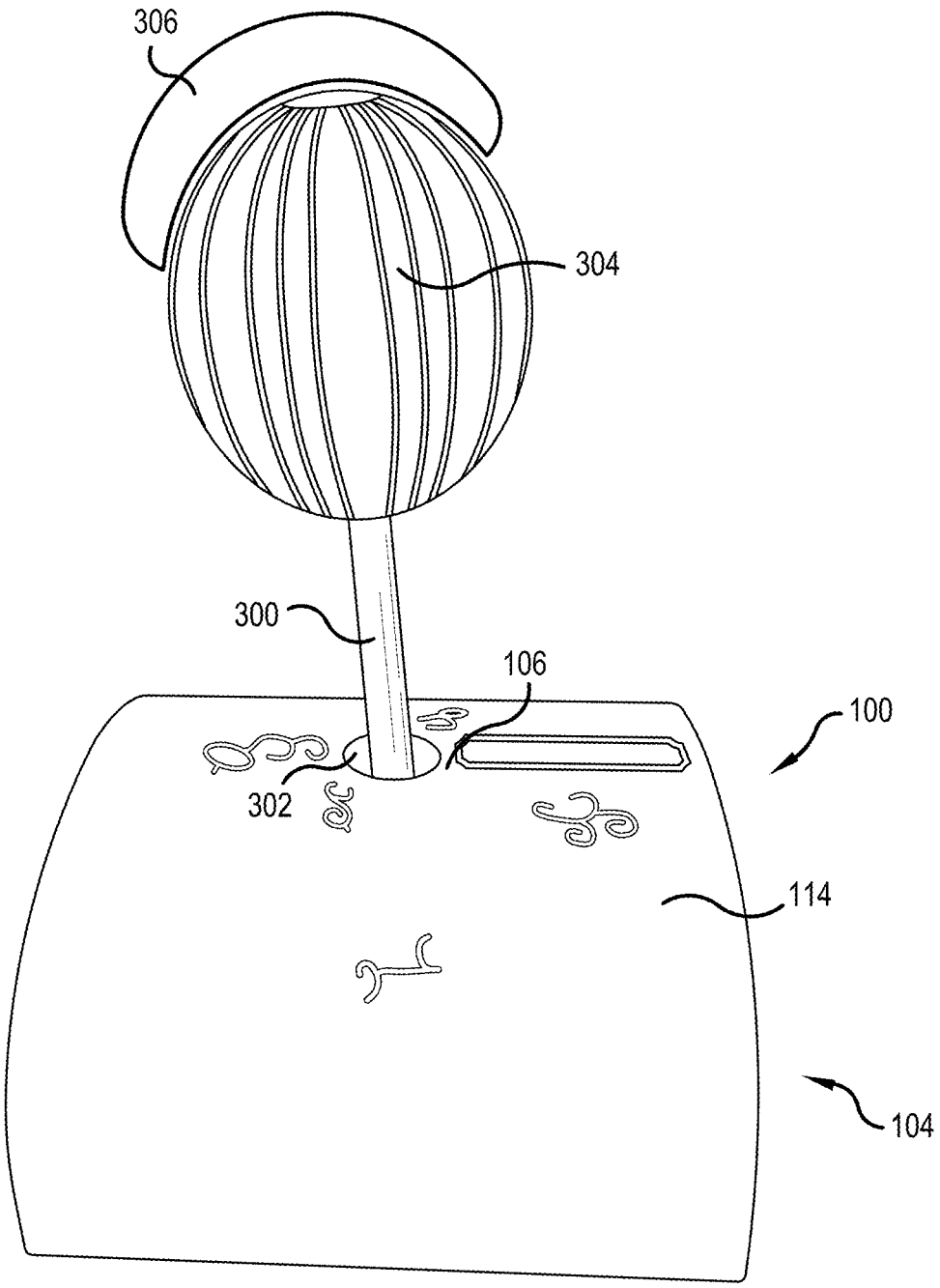
FIG. 5 shows a front perspective view of the adjustable rod, in a lower orientation, having an end connected to an anchoring structure within a compartment of an opening of the radiused wall of the vessel and another end of the rod connected to a hairpiece support structure, in accordance with an exemplary embodiment of the present invention.

FIGS. 3, 4, and 5 illustrate the vessel 100 of FIGS. 1A, 1B, and 2 having the lid 108 removed to expose the opening 106 on the base 114. The vessel 100 has a closed orientation 104. A first rod 300 is inserted through opening 106 bordering a compartment 302. The first rod 300 is positioned in an upright orientation when retained by compartment 302. The support structure 304 is connected to the first rod 300. The support structure 304 is configured to receive at least a portion of a hairpiece 306. A second rod 700 can be connected to 300 first rod to extend the height of the connected rods 300, 700.

Figure 6A:
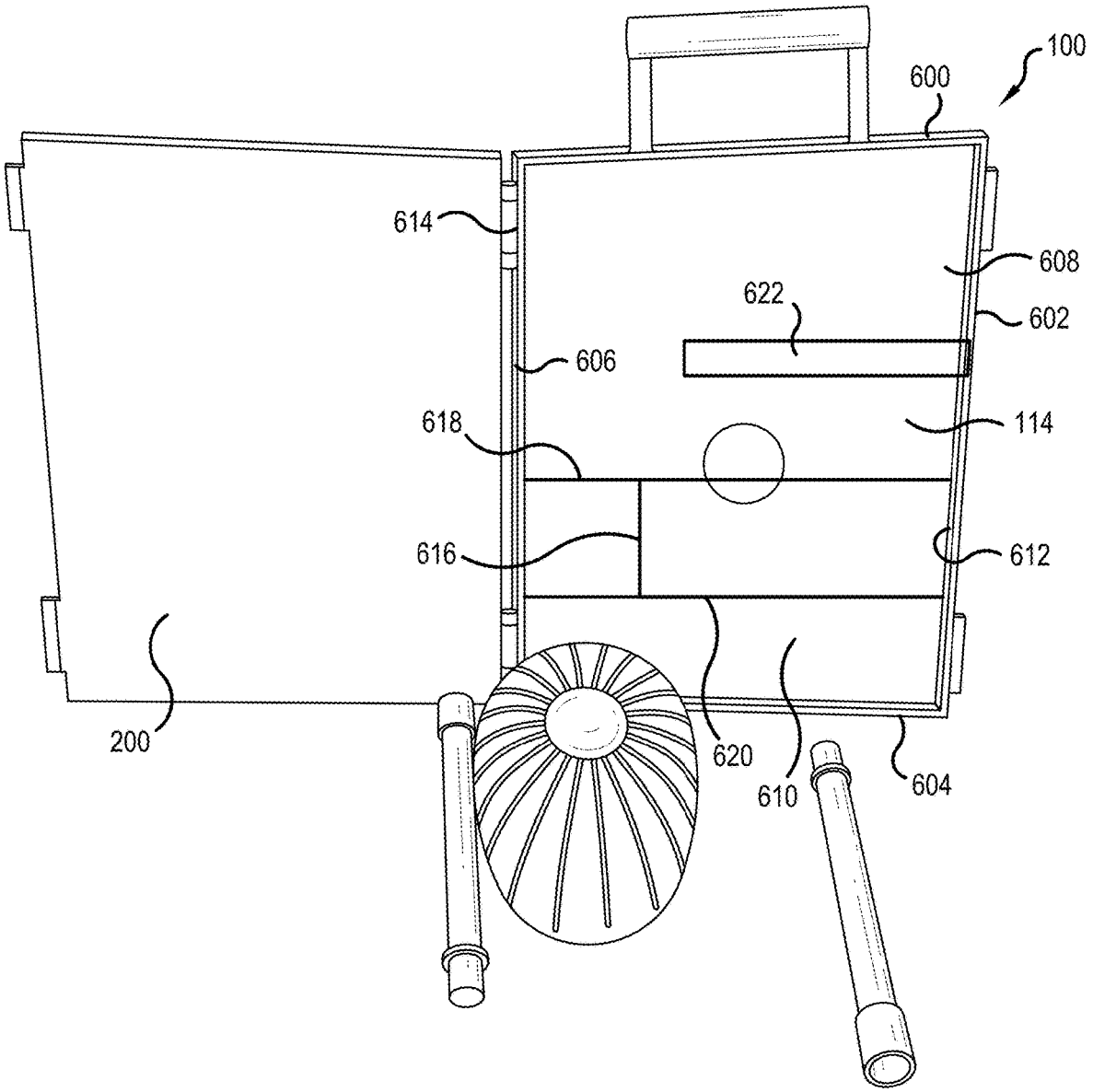
FIGS. 6A, and 6B shows a top perspective view of the vessel in an open orientation having a chamber configured to retain an adjustable rod and a hairpiece support structure, in a retracted orientation, in accordance with an exemplary embodiment of the present invention.
Figure 6B:
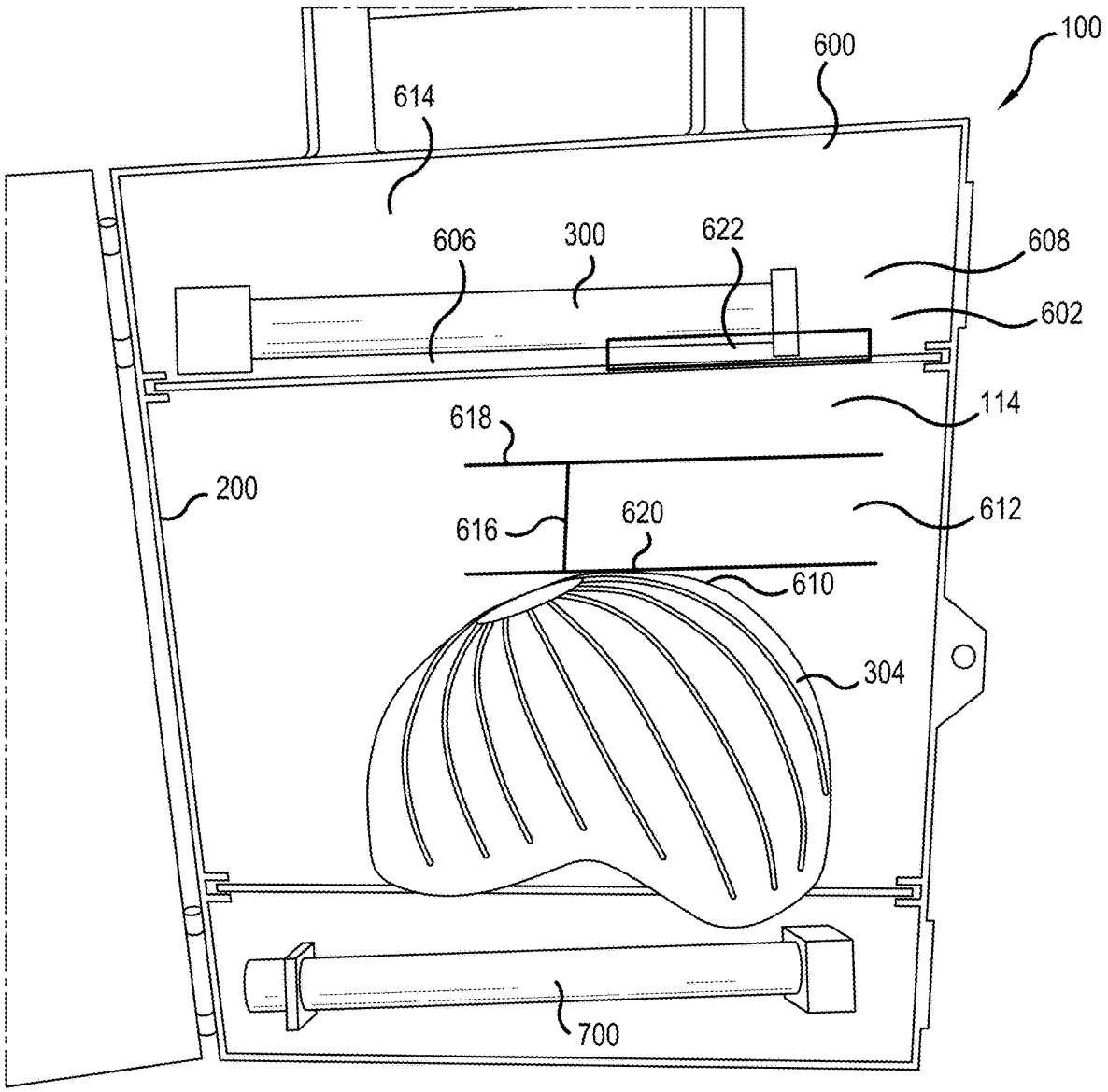

FIGS. 6A, and 6B illustrates vessel 100 four sidewalls 600, 602, 604, and 604. The base 114 has an outer perimeter edge 608. The outer perimeter edge 608 of the base 114 is connected to the four sidewalls 600, 602, 604, and 604 to form a chamber 610. The chamber 610 has an inner wall 612. The cover 200 is removably connected to the four sidewalls. The cover 200 is hingedly pivotable 614. The cover 200 is substantially planar. The chamber 610 has multiple compartments divided by one or more dividers 616, 618, and 620. The one or more shelving units 622 are connected to the inner wall 612 of the chamber 610. As shown in FIG. 6B, the support structure 304 can be stored inside of the vessel in chamber 610. The rods 700 and 300 can also be fitted in the vessel, above and below the support structure 304.

Figure 7:
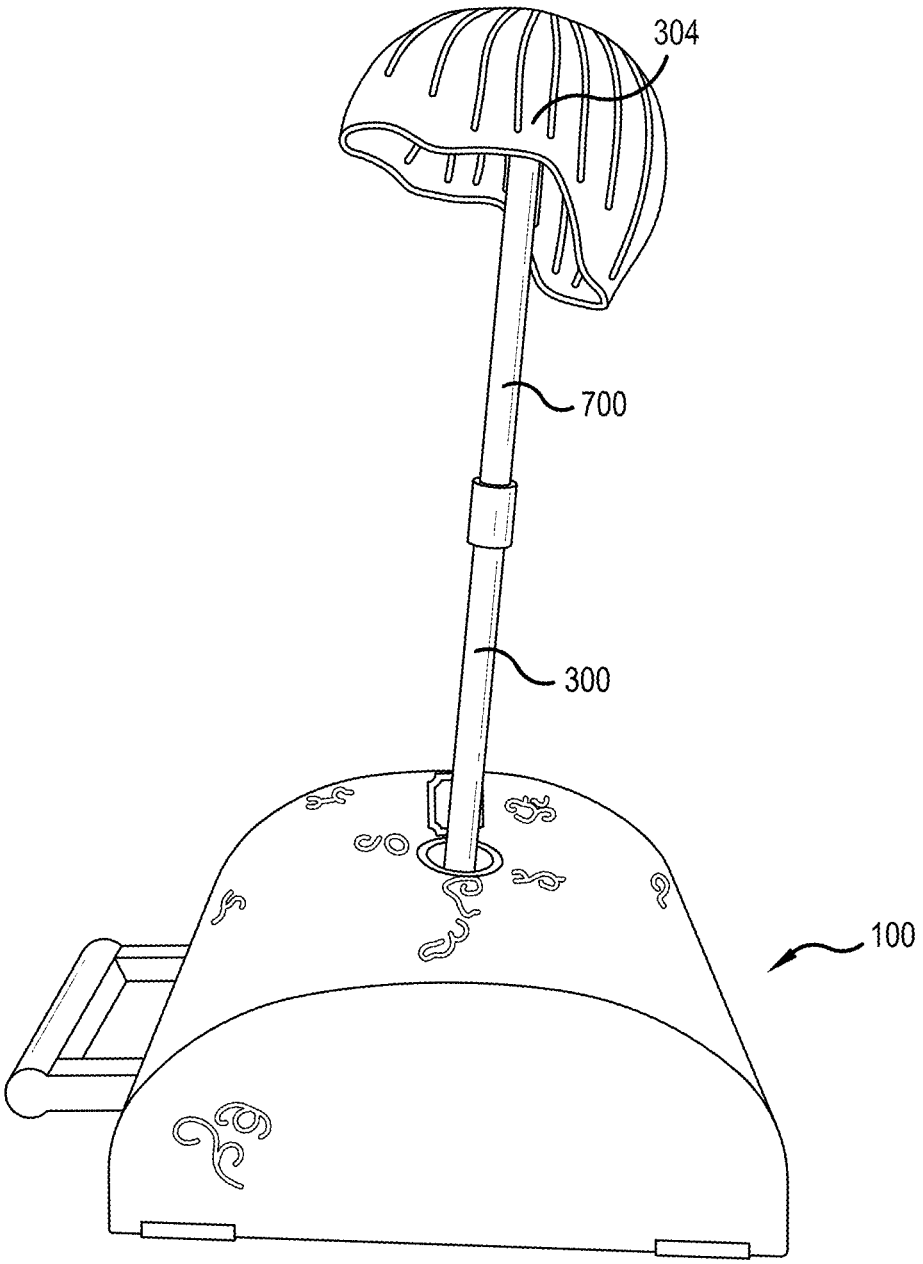
FIG. 7 shows a left side perspective view of the adjustable rod, in an extended orientation, having an end connected to an anchoring structure within a compartment of an opening of the radiused wall of the vessel and another end of the rod connected to a hairpiece support structure, in accordance with an exemplary embodiment of the present invention.

FIG. 7 illustrates the vessel 100 of FIGS. 3A, 3B, 4A, 4B and 5 having a first rod 300 connected to a second rod 700. This lengthened configuration extends the length of the rod so as to allow a wig having a longer length of hair to be supported by support structure 304. Alternatively, the rod may be telescoping from a retracted orientation to an extended orientation.

Figure 8:
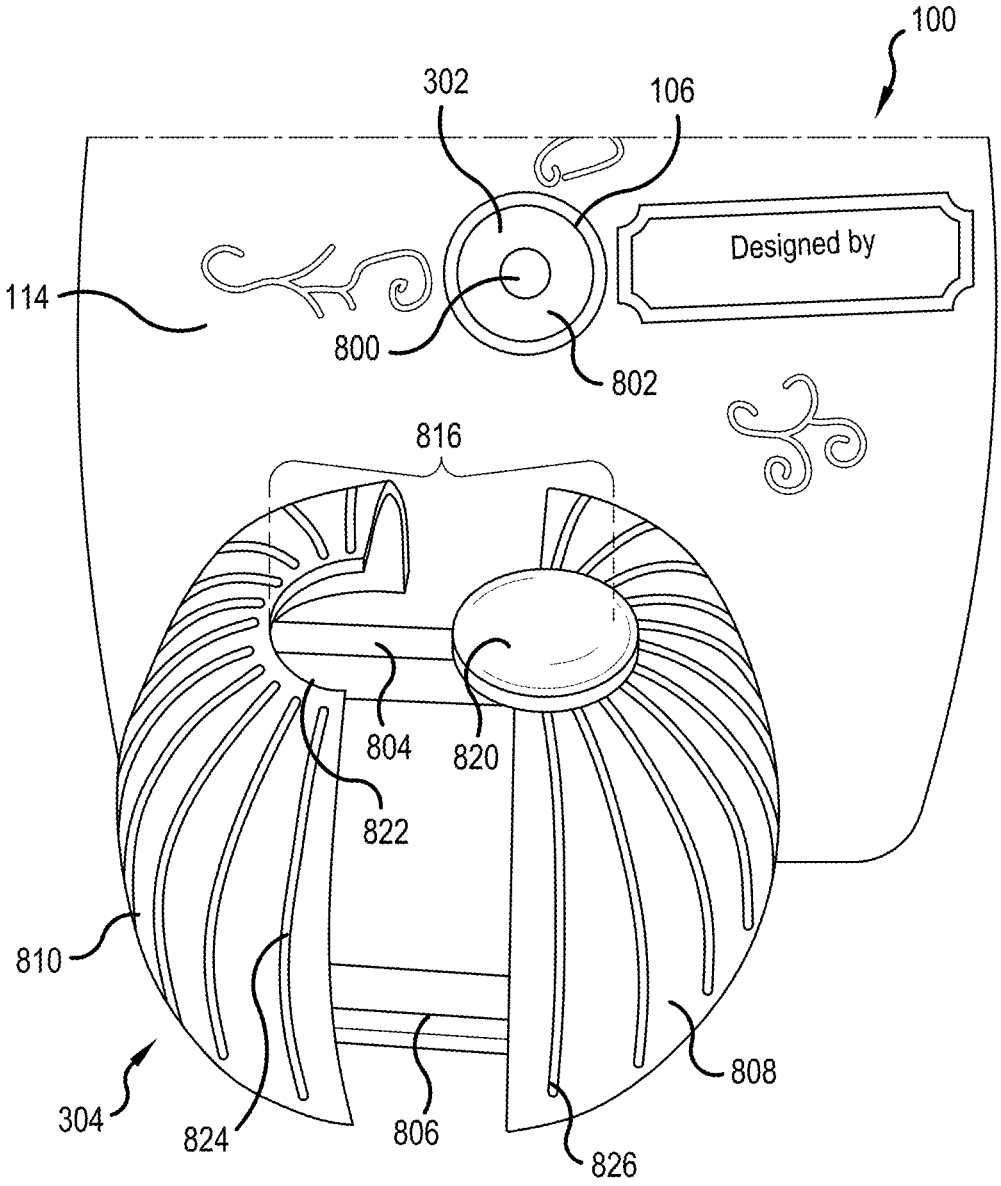
FIG. 8 shows a top perspective view of the vessel having a chamber with an anchoring structure and a top perspective view of the hairpiece support structure in an extended orientation, in accordance with an exemplary embodiment of the present invention.
Figure 9A:
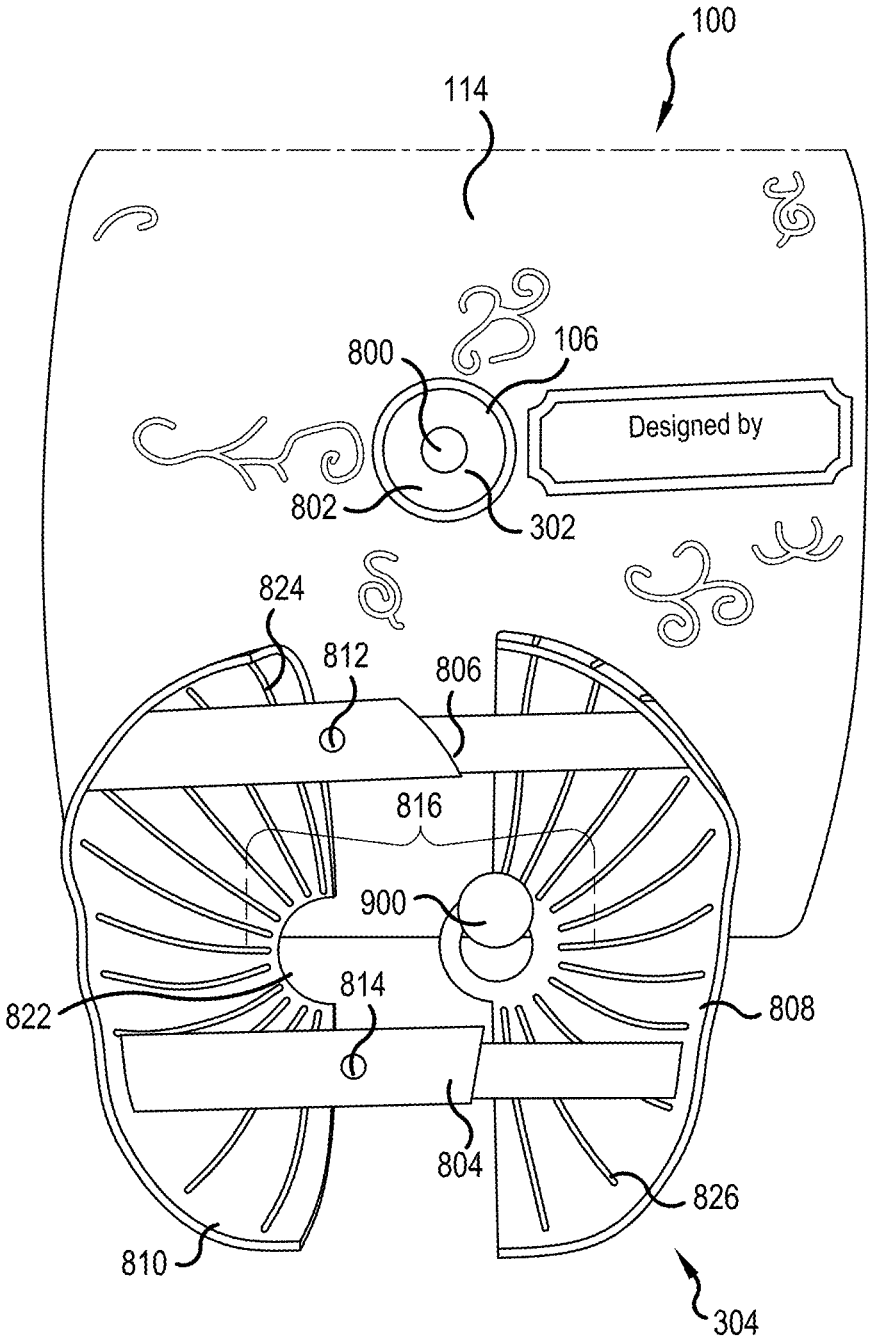
FIGS. 9A and 9B shows a top perspective view of the vessel having a chamber with an anchoring structure and a rear perspective view of the hairpiece support structure in an extended orientation, in accordance with an exemplary embodiment of the present invention.
Figure 9B:
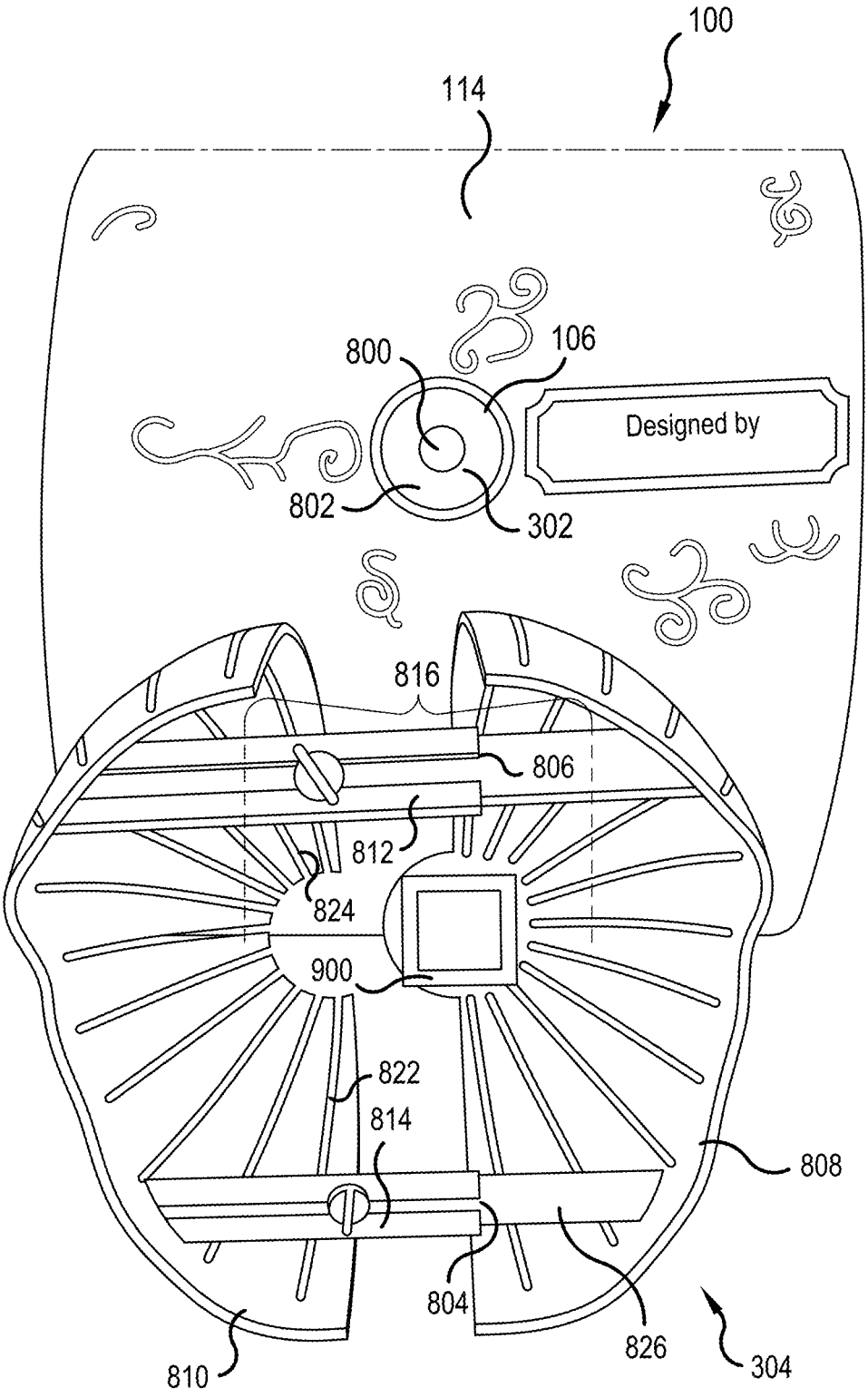

FIGS. 8, 9A, and 9B illustrate vessel 100 having the base 114 having an opening 106 bordering a compartment 302. The compartment 302 has an anchoring structure 800 extending therefrom. The anchoring structure 800 is a protrusion extending from the floor 802 of the compartment 302. The support structure 304 has one or more tracks 804 and 806, the one or more tracks 804 and 806 are configured to expand and retract a first portion 808 of the support structure 304 and a second portion 810 of the support structure 304. The support structure 304 has a lock and key mechanism 816. A convex structure 820 is located on the first portion 808 of the support structure 304. The recess 822 is located on the second portion 810 of the support structure 304. The convex structure 820 is configured to be received by the recess 822 when the support structure 304 is retracted along the one or more tracks 804 and 806. The support structure 304 has a plurality of slits 826 radiating from the convex structure 820 first portion 808 of the support structure 304. The plurality of slits 826 traversing the length of the first portion of the support structure. The support structure 304 has a plurality of slits 824 radiating from the recess 822 of the second portion 810 of the support structure 304. The plurality of slits 824 traverse the length of the first portion 808 of the support structure 304. The slits allow air to pass through to aid in either drying the hair on the structure 304 or helping to maintain its freshness by allowing air flow. Furthermore, strands of hair can be placed between the slits so that the strands can be supported and stored on the surface of the structure.

FIGS. 9A and 9B illustrates the one or more tracks 804 and 806 having one or more openings 812 and 814 configured to receive a fastener (not shown). The support structure 304 has a receiving structure 900. The receiving structure 900 is configured to retain at least a portion of the first rod. The receiving structure 900 is located on the convex structure 820.

Throughout this application, various publications can be referenced. The disclosures of these publications in their entirety are hereby incorporated by reference into this application in order to more fully describe the state of the art to which this pertains. The references disclosed are also individually and specifically incorporated by reference herein for the material contained in them that is discussed in the sentence in which the reference is relied upon. Nothing herein is to be construed as an admission that the present invention is not entitled to antedate such publication by virtue of prior invention. Further, the dates of publication provided herein can be different from the actual publication dates, which can require independent confirmation.

The storage vessel or container may be cylindrical in shape and feature decorative patterns, as shown in FIGS. 1A and 1B. It may have an arched handle on top for easy carrying (FIG. 1A) and a removable lid or cover (FIGS. 1A and 6A). The base of the container may be rectangular with decorative etchings (FIG. 5).

In one or more embodiments, the hairpiece stand may comprise an adjustable rod, composed of two cylindrical rods that can be connected to extend its length (FIGS. 1B and 6A), may be inserted into an anchoring structure located in the base (FIGS. 3, 4, and 5). The expandable support structure may be a dome-shaped component designed to mimic the shape of a human head (FIGS. 1B, 3, 4, and 5). It may feature vertical slits or ridges, allowing for expansion and retraction (FIGS. 5, 6A, 8, and 9A), and may be opened to reveal its internal structure (FIGS. 8 and 9B). This support structure may attach to the top of the adjustable rod (FIGS. 3, 4, 5, and 7). The design may be multi-functional, allowing the components to be stored within the vessel when not in use (FIGS. 6A and 6B). The vessel itself may serve as both a storage container and a display stand base (FIGS. 3, 4, and 7).

In one or more embodiments, the hairpiece stand system may include adjustability features, such as the ability to adjust the rod's height by connecting multiple sections or using a telescoping mechanism (FIGS. 1B and 7). The support structure may expand or retract to accommodate different wig sizes (FIGS. 8, 9A, and 9B). In one or more embodiments, the hairpiece stand may include additional features including but not limited to a potential locking mechanism on the vessel (FIG. 1A), internal compartments or shelving within the vessel (FIG. 6B), and decorative elements on various components (FIGS. 1A, 5, 8, and 9A).

In one or more embodiments, the hairpiece stand invention combines storage, display, and adjustability features in a single, portable device designed to accommodate various wig sizes and styles while providing convenient storage and transportation options.

These drawings illustrate the key aspects of the invention, showing how it can function as both a storage solution and display stand for hairpieces, with adjustable components to accommodate various sizes and styles. Other examples that occur to those skilled in the art. Such other examples are intended to be within the scope of the claims if they have structural elements that do not differ from the literal language of the claims, or if they include equivalent structural elements with insubstantial differences from the literal languages of the claims.

While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as examples for embodiments of the disclosure.

Insofar as the description above and the accompanying drawing disclose any additional subject matter that is not within the scope of the claims below, the disclosures are not dedicated to the public and the right to file one or more applications to claims such additional disclosures is reserved.

Although very narrow claims are presented herein, it should be recognized the scope of this disclosure is much broader than presented by the claims. It is intended that broader claims will be submitted in an application that claims the benefit of priority from this application.

What is claimed:

1. A vessel, comprising:

four sidewalls;

a base, the base having an outer perimeter edge, the outer perimeter edge of the base is connected to the four sidewalls to form a chamber, the chamber having an inner wall, the base having an opening bordering a compartment, the compartment having an anchoring structure;

a first rod, the first rod is removably connected to the anchoring structure;

a support structure, the support structure is connected to the first rod, the support structure is configured to receive at least a portion of a hairpiece;

wherein the support structure having one or more tracks, the one or more tracks are configured to expand and retract a first portion of the support structure and a second portion of the support structure, wherein the support structure having a lock and key mechanism comprising:

a convex structure, the convex structure is located on the first portion of the support structure;

a recess, the recess is located on the second portion of the support structure, and wherein the convex structure is configured to be received by the recess when the support structure is retracted along the one or more tracks; and a cover, the cover is removably connected to the four sidewalls.

2. The vessel of claim 1, wherein the base having a radiused wall.

3. The vessel of claim 1, wherein the cover is hingedly pivotable.

4. The vessel of claim 1, wherein the cover is substantially planar.

5. The vessel of claim 1, wherein the chamber having multiple compartments divided by one or more dividers.

6. The vessel of claim 1, further comprising:

one or more shelving units, the one or more shelving units are connected to the inner wall of the chamber.

7. The vessel of claim 1, further comprising:

a handle, the handle is connected to one side wall of the four side walls, the handle is configured to be grasped by a user.

8. The vessel of claim 1, wherein the anchoring structure is a protrusion extending from a floor of the compartment.

9. The vessel of claim 1, wherein the first rod is configured to telescope from a retracted position to an extended position.

10. The vessel of claim 1, wherein the first rod having a first end located opposite a second end, the first end of the first rod is removably connected to the anchoring structure, the second end of the first rod is connected to a first end of a second rod.

11. The vessel of claim 1, wherein the first rod having a substantially central bore, at least a portion of the substantially central bore of the first rod is configured to be received by the anchoring structure during installation.

12. The vessel of claim 1, wherein the one or more tracks having one or more openings configured to receive a fastener.

13. The vessel of claim 1, wherein the support structure having a receiving structure, the receiving structure retains at least a portion of the first rod.

14. The vessel of claim 1, further comprising:

a receiving structure, the receiving structure retains at least a portion of the first rod, the receiving structure is located on the convex structure.

15. The vessel of claim 1, wherein the support structure having a plurality of slits radiating from the convex structure first portion of the support structure, the plurality of slits traversing the length of the first portion of the support structure.

16. The vessel of claim 1, wherein the support structure having a plurality of slits radiating from the recess of the second portion of the support structure, the plurality of slits traversing the length of the first portion of the support structure.

* * * * *